US007783215B2

(12) United States Patent
Tanaka

(10) Patent No.: US 7,783,215 B2
(45) Date of Patent: Aug. 24, 2010

(54) IMAGE FORMING APPARATUS AND TONER REPLENISHMENT CONTROL METHOD

(75) Inventor: Tatsuya Tanaka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 344 days.

(21) Appl. No.: 12/073,619

(22) Filed: Mar. 7, 2008

(65) Prior Publication Data

US 2008/0240760 A1 Oct. 2, 2008

(30) Foreign Application Priority Data

Mar. 26, 2007 (JP) ..... 2007-079419

(51) Int. Cl.
*G03G 15/08* (2006.01)

(52) U.S. Cl. ..... 399/62; 399/30; 399/258

(58) Field of Classification Search ..... 399/258, 399/259, 58, 62, 30
See application file for complete search history.

(56) References Cited

U.S. PATENT DOCUMENTS 5,724,627 A * 3/1998 Okuno et al. ..... 399/58
2007/0098449 A1* 5/2007 Kadota et al. ..... 399/258
2007/0269235 A1* 11/2007 Hirose ..... 399/258

FOREIGN PATENT DOCUMENTS

JP 8-50407 2/1996
JP 9-160364 6/1997

* cited by examiner

*Primary Examiner*—Susan S Lee
(74) *Attorney, Agent, or Firm*—Nixon & Vanderhye, P.C.

(57) ABSTRACT

An image forming apparatus and a toner replenishment control method according to the present invention are configured such that a concentration of toner in a developer detected by a toner concentration detection sensor is measured and the measured toner concentration value is stored. These are configured such that regions of image data corresponding to an electrostatic latent image on an image bearing member to be developed by the developer are specified and an amount of toner to be consumed in the developer is predicted based on the image data of the specified regions, then a post-development concentration value of toner in the developer is estimated based on the measured toner concentration value and the predicted toner consumption amount, and control of replenishment of toner to the developer is carried out based on the estimated post-development toner concentration value and a toner setting concentration value that has been set in advance.

17 Claims, 9 Drawing Sheets

IMAGE FORMING APPARATUS AND TONER REPLENISHMENT CONTROL METHOD

This application claims priority under 35 U.S.C. § 119(a) on Patent Application No. 2007-079419 filed in Japan on Mar. 26, 2007, the entire contents of which are hereby incorporated by reference.

BACKGROUND OF THE INVENTION

1. Field of the Invention

The present invention relates to electrophotographic image forming apparatuses such as digital multifunction machines that carry out image forming using a two-component developer containing toner and a carrier, and to toner replenishment control methods.

2. Description of the Related Art

Some conventional electrophotographic image forming apparatuses involve charging a surface of an image bearing member (for example, a photosensitive body), then forming an electrostatic latent image on a charged region thereof by performing image exposure (for example, irradiating a laser beam) based on image data that has been stored in a storage portion. This electrostatic latent image is made into a visible image (developed) as a toner image by a development apparatus, and after this toner image that has been made into a visible image is electrostatically transferred to a recording material such as a recording paper, the toner image that has been transferred to the recording material is made to bind to the recording material by a fixing apparatus.

When carrying out developing using a two-component developer containing toner and a carrier in this type of image forming apparatus, a system is generally employed involving causing only the toner to adhere to the image bearing member and be consumed, the toner being from the toner and carrier in the developer that is borne on a developer bearing member in the development apparatus. For this reason, toner replenishment control is implemented by which toner is replenished as appropriate to the developer in order to properly maintain a concentration of toner in the developer in the development apparatus.

In image forming apparatuses that use a two-component developer, ordinarily the concentration of toner in the developer is directly or indirectly detected by a sensor, and control of replenishment of toner to the developer is carried out based on these detection values. A magnetic permeability sensor that detects the carrier component in the developer can be given as a typical example of a sensor that detects the concentration of toner in the developer.

With these conventional image forming apparatuses, it is generally common that toner replenishment control is carried out using only the detection values of the sensor that detects the toner concentration, and in this case there is no implementation of toner replenishment control conforming to the image data that corresponds to the electrostatic latent image on the image bearing member, which is to be developed by the developer.

In this regard, JP H09-160364A discloses an image forming apparatus in which toner replenishment control is carried out without using a sensor that detects the toner concentration by detecting a number of pixels to be written so as to estimate a toner consumption amount.

However, although toner replenishment control can be carried out in the image forming apparatus described in JP H09-160364A based on the toner consumption amount that is estimated from the image data, there are cases where error accumulates since no sensor is used to detect the toner concentration. For this reason, there is a risk that the toner concentration will deviate greatly from the proper value as image forming is carried out, and there will be poor accuracy in estimating the toner consumption amount. Consequently, the accuracy of toner replenishment control will worsen.

SUMMARY OF THE INVENTION

The present invention has been devised in light of these problems, and it is an object thereof to provide an image forming apparatus and a toner replenishment control method that are capable of carrying out control of toner replenishment to the developer with excellent accuracy conforming to image data corresponding to the electrostatic latent image on the image bearing member to be developed by the developer.

An image forming apparatus according to the present invention is provided with a storage portion, an image bearing member on which an electrostatic latent image is to be formed based on image data stored in the storage portion, and a development apparatus that develops the electrostatic latent image formed on the image bearing member as a toner image using a two-component developer including toner and a carrier, wherein the development apparatus is provided with: a developer bearing member that bears the developer, a circulation transport portion that circulates the developer in a loop shape such that the developer is transported in a transport direction along an axial direction of the developer bearing member while being supplied to a circumferential surface of the developer bearing member, and a toner concentration detection sensor that detects a concentration of toner in the developer that circulates in the circulation transport portion, and is configured to carry out replenishment of toner to the developer in the circulation transport portion, wherein the image forming apparatus is provided with: a toner concentration measuring means that measures the concentration of toner in the developer, which is detected by the toner concentration detection sensor, for each predetermined transport length along the developer transport direction, a storage means that stores in the storage portion a measured toner concentration value of the developer in each transport length measured by the toner concentration measuring means, a toner consumption amount predicting means that specifies, among image data stored in the storage portion, regions of the image data corresponding to the electrostatic latent image on the image bearing member to be developed by the developer in each transport length, and predicts toner consumption amounts of the developer in each corresponding transport length based on image data of the specified regions for the developer in each transport length that has been specified, a toner concentration estimating means that, based on the measured toner concentration values of the developer in each transport length stored in the storage portion by the storage means and the predicted toner consumption amounts of the developer in each corresponding transport length predicted by the toner consumption amount predicting means, estimates toner concentrations in the developer after development using the developer in each corresponding transport length, and a toner replenishment control means that, based on the estimated post-development toner concentration values of the developer in each transport length estimated by the toner concentration estimating means and a toner setting concentration value that has been set in advance, carries out control of toner replenishment to the developer in each corresponding transport length.

With this configuration, the toner concentration detection sensor is used, and the estimated post-development toner concentration values are estimated according to the measured toner concentration values detected by the toner concentration detection sensor and the predicted toner consumption amounts that have been predicted from the image data of the specified regions, and since toner replenishment control is carried out to the developer based on the estimated post-development toner concentration values that have been estimated and the toner setting concentration values, it becomes possible to carry out control of toner replenishment to the developer with excellent accuracy conforming to the image data corresponding to the electrostatic latent image on the image bearing member to be developed by the developer.

Furthermore, in the image forming apparatus according to the present invention, the circulation transport portion may be provided with: a first transport path extending in the axial direction so as to supply the developer to the developer bearing member, a second transport path that extends along the first transport path and communicates with the first transport path so as to form with the first transport path a loop shape circulation transport path, a first transport member that transports the developer in the first transport path from a one side to another side of the axial direction, and a second transport member that transports the developer in the second transport path from the other side to the one side of the axial direction, and may be configured so that the first and second transport members work together in the circulation transport path formed by the first and second transport paths to circulate the developer, wherein the toner concentration detection sensor is provided in the second transport path and toner replenishment to the developer is carried out in the second transport path.

Furthermore, in the image forming apparatus according to the present invention, the toner concentration detection sensor may be arranged on a downstream side in the developer transport direction from a position at which toner is replenished to the developer, based on a replenishment amount of toner to the developer to be replenished in each transport length by the toner replenishment control means, the toner concentration estimating means estimates toner concentrations in the developer after toner replenishment to the developer in each corresponding transport length, then adds differences that are obtained by comparing the estimated post-replenishment toner concentration values estimated for the developer in each transport length and the measured toner concentration values of the developer in each corresponding transport length as measured by the toner concentration measuring means after toner has been replenished by the toner replenishment control means, and based on an added value that has been obtained by the addition by the toner concentration estimating means, the toner replenishment control means adjusts the toner setting concentration value.

With this configuration, errors in the toner replenishment amounts that are replenished by the toner replenishment control means can be corrected automatically.

Furthermore, in giving consideration to averaging the toner concentrations by an agitation effect or the like during transport of the developer that actually circulates in the circulation transport portion and from the perspective of reflecting this in the estimated toner concentration values, in the image forming apparatus according to the present invention, the toner concentration estimating means may carry out an averaging process on the estimated post-development toner concentration values of the developer that have been estimated in each transport length. Alternatively, the toner concentration estimating means may carry out an averaging process on the estimated post-replenishment toner concentration values of the developer that have been estimated in each transport length.

With this configuration, the averaging process can be carried out using an estimated toner concentration value different from the estimated toner concentration value targeted for processing. For example, the averaging process may be carried out by obtaining an average value of one proximal or a plurality of consecutive estimated toner concentration values including an estimated toner concentration value targeted for processing. Alternatively, the averaging process may be carried out according to a convolution operation that uses a distribution function.

In the image forming apparatus according to the present invention, an embodiment can be illustrated in which the toner consumption amount predicting means performs divisions in the developer transport direction and a direction that intersects perpendicularly to the developer transport direction respectively on regions of images corresponding to the electrostatic latent image on the image bearing member, which are formed based on the image data stored in the storage portion, thereby obtaining rectangular image blocks, and based on image data corresponding to the image blocks that have been obtained, predicts toner consumption amounts of developer to be consumed in the image blocks, and determines predicted toner consumption amounts of developer in each corresponding transport length based on predicted toner consumption amounts of the image blocks corresponding to the image data of the specified regions for the developer in each transport length.

With this configuration, the predicted toner consumption amount can be determined for developer in each corresponding transport length from the predicted toner consumption amounts of the image blocks, and therefore it is possible to simplify the arithmetic processing for obtaining the predicted toner consumption amount of developer in each transport length.

In this case, further illustration can be provided with the following specific embodiments. Namely:

(X) An embodiment in which, in obtaining the predicted toner consumption amounts of developer in each transport length, the toner consumption amount predicting means uses a total predicted toner consumption amount of image blocks corresponding to the specified region image data for developer in each corresponding transport length as the predicted toner consumption amounts of developer in each transport length, thereby obtaining predicted toner consumption amounts of developer in each corresponding transport length.

(Y) An embodiment in which a coefficient corresponding to an overlap extent, by which a development trajectory virtual line, along which the developer in each transport length moves on the image bearing member during development, and the image blocks overlap, is set in advance for each of the image blocks, and in obtaining the predicted toner consumption amounts of developer in each transport length, the toner consumption amount predicting means multiplies the predicted toner consumption amounts of the image blocks that overlap the development trajectory virtual line of the developer in each transport length by the coefficient that corresponds to the overlap extent with the image blocks, then obtains a total thereof, thereby obtaining predicted toner consumption amounts of developer in the corresponding transport lengths.

Compared to the (X) embodiment, with the (Y) embodiment, predicted toner consumption amounts of developer in each transport length can be obtained with excellent accuracy.

Furthermore, in a case where predicted toner consumption amounts of developer in each corresponding transport length is to be obtained from the predicted toner consumption amount of the image blocks, the toner consumption amount predicting means may set a time of one circuit of the developer that circulates in the circulation transport portion of the development apparatus as an integral multiple of a time required for a single cycle of image forming. By doing this, the image blocks corresponding to image data of the specified regions of developer in each transport length agree with an integral multiple of time required for a single cycle of image forming, and the arithmetic processing for obtaining predicted toner consumption amounts of the developer in each transport length can be simplified by an equivalent proportion.

A toner replenishment control method according to the present invention is for an image forming apparatus provided with a storage portion, an image bearing member on which an electrostatic latent image is to be formed based on image data stored in the storage portion, and a development apparatus that develops the electrostatic latent image formed on the image bearing member as a toner image using a two-component developer including toner and a carrier, wherein the development apparatus is provided with: a developer bearing member that bears the developer, a circulation transport portion that circulates the developer in a loop shape such that the developer is transported in a transport direction along an axial direction of the developer bearing member while being supplied to a circumferential surface of the developer bearing member, and a toner concentration detection sensor that detects a concentration of toner in the developer that circulates in the circulation transport portion, and is configured to carry out replenishment of toner to the developer in the circulation transport portion, wherein the toner replenishment control method includes: measuring the concentration of toner in the developer, which is detected by the toner concentration detection sensor, for each predetermined transport length along the developer transport direction, storing in the storage portion a measured toner concentration value of the developer in each transport length that has been measured, specifying, among image data stored in the storage portion, regions of the image data corresponding to the electrostatic latent image on the image bearing member to be developed by the developer in each transport length, and predicting toner consumption amounts of the developer in each corresponding transport length based on image data of the specified regions for the developer in each transport length that has been specified, estimating, based on the measured toner concentration values of the developer in each transport length stored in the storage portion and the predicted toner consumption amounts of the developer in each corresponding transport length, toner concentrations in the developer after development using the developer in each corresponding transport length, and carrying out, based on the estimated post-development toner concentration values of the developer in each transport length and a toner setting concentration value that has been set in advance, control of toner replenishment to the developer in each corresponding transport length.

With this configuration, the toner concentration detection sensor is used, and the estimated post-development toner concentration values are estimated according to the measured toner concentration values detected by the toner concentration detection sensor and the predicted toner consumption amounts that have been predicted from the image data of the specified regions, and since toner replenishment control is carried out to the developer based on the estimated post-development toner concentration values that have been estimated and the toner setting concentration values, it becomes possible to carry out control of toner replenishment to the developer with excellent accuracy conforming to the image data corresponding to the electrostatic latent image on the image bearing member to be developed by the developer.

DESCRIPTION OF THE PREFERRED EMBODIMENTS

Hereinafter, embodiments of the present invention are described in detail with reference to the accompanying drawings.

Figure 1:
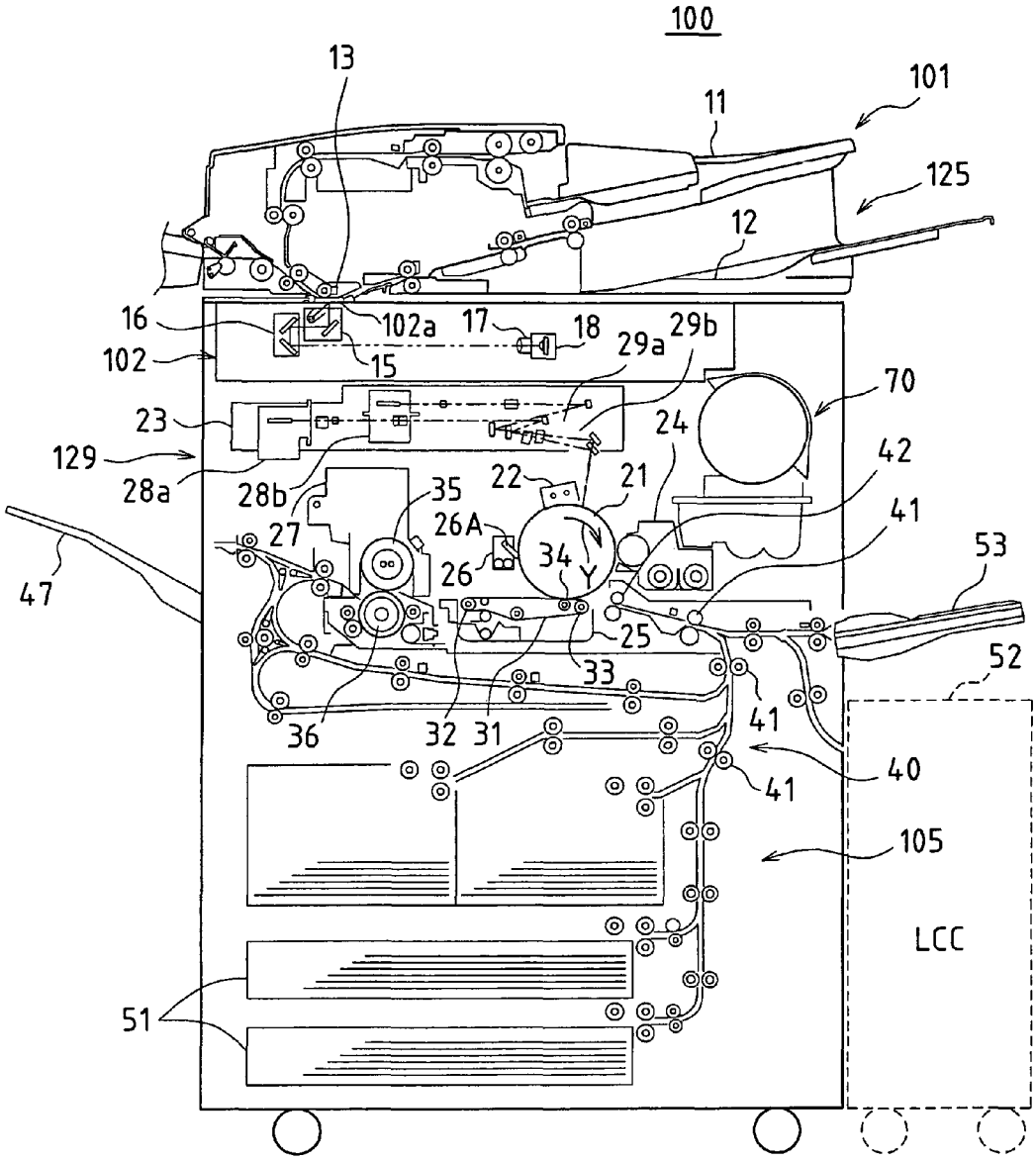
FIG. 1 is an outline lateral view showing an outline configuration of an image forming apparatus according to an embodiment of the present invention.

FIG. 1 is a schematic lateral view showing one embodiment of an image forming apparatus according to the present invention.

First, description is given regarding an overall structure of an image forming apparatus 100 shown in FIG. 1. Here the image forming apparatus 100 shown in FIG. 1 is a digital multifunction machine that forms images using an electrophotographic image forming process. The image forming apparatus 100 is provided with an image bearing member (here, a photosensitive drum) 21, a charging device (here, a charging unit) 22 for charging a surface of the photosensitive drum 21, an optical writing unit 23 for forming an electrostatic latent image on the photosensitive drum 21, a development apparatus 24 for forming a toner image on the photosensitive drum 21 by making visible (developing) the electrostatic latent image using a developer, a transfer apparatus (here, a transfer unit) 25 for transferring the toner image on the photosensitive drum 21 to a recording material such as a recording paper, a fixing apparatus (here, a fixing unit) 27 for fixing the transferred image on the recording material to the recording material, and a cleaning apparatus (here, a cleaner unit) 26 for removing residual toner that has not been transferred by the transfer unit 25 and is left on the surface of the photosensitive drum 21.

Specifically, the image forming apparatus 100 is an apparatus that obtains image data that has been read from an original, or obtains image data that has been received from an external processing device (see FIG. 4 described later) 123 such as a personal computer or a facsimile machine, and forms on the recording material a monochrome image that is indicated by the image data. Broadly classified, the structure of the image forming apparatus 100 is constituted by an original transport portion (ADF) 101, and image reading portion 102, an image forming portion (hereinafter referred to as "printer engine") 129, a transport path 40, and a paper feed portion 105.

When at least one sheet of an original is set in an original setting tray 11, the original transport portion 101 withdraws and transports the originals from the original setting tray 11 sheet by sheet. Furthermore, the original transport portion 101 guides the original over an original reading window 102*a* of the image reading portion 102 and discharges the original to an original discharge tray 12.

A CIS (contact image sensor) 13 is arranged above the original reading window 102*a*. When the original passes over the original reading window 102*a*, the CIS 13 repetitively reads in a main scanning direction an image of a back side of the original and outputs image data that indicates an image of the back side of the original.

When the original passes over the original reading window 102*a*, the image reading portion 102 exposes a front side of the original using a lamp of a first scanning unit 15. Furthermore, the image reading portion 102 guides reflected light from the front side of the original paper to an imaging lens 17 using mirrors of the first and a second scanning unit 15 and 16, and an image of the front side of the original paper is imaged onto a CCD (charge coupled device) 18 by the imaging lens 17. The CCD 18 repetitively reads in a main scanning direction an image of the front side of the original and outputs image data that indicates an image of the front side of the original.

Further still, in a case where the original is placed onto a platen glass on an upper surface of the image reading portion 102, the image reading portion 102 causes the first and second scanning units 15 and 16 to move while maintaining a predetermined velocity relationship to each other such that the front side of the original on the platen glass is exposed by the first scanning unit 15. Furthermore, the image reading portion 102 guides reflected light from the front side of the original to an imaging lens 17 using the first and second scanning unit 15 and 16, and an image of the front side of the original is imaged onto a CCD 18 by the imaging lens 17.

Image data that has been outputted from the CIS 13 or the CCD 18 undergoes various types of image processing by a control portion 200 and a storage portion 150, which are described later (omitted in FIG. 1, see FIG. 4), then outputted to the printer engine 129.

It should be noted that the original transport portion (ADF) 101 and the image reading portion 102 constitute an image scanner unit 125.

The printer engine 129 is for recording an image of an original onto the recording material based on image data stored in the storage portion 150, and is provided with the aforementioned photosensitive drum 21, the charging unit 22, the optical writing unit 23, the development apparatus 24, the transfer unit 25, the cleaner unit 26, and the fixing unit 27.

The photosensitive drum 21 is rotationally driven at a predetermined fixed peripheral velocity Vc in a predetermined rotation direction (arrow Y direction in the diagram). The photosensitive drum 21 is configured such that an electrostatic latent image is formed based on image data stored in the storage portion 150. Here the photosensitive drum 21 is an organic photosensitive body whose surface layer is constituted by an organic photoconductive material.

Here the charging unit 22 is a charger type component. It should be noted that the charging unit 22 may also be a roller type or brush type unit that makes contact with the photosensitive drum 21.

Here the optical writing unit 23 is a laser scanning unit (LSU) provided with two laser irradiation portions 28*a* and 28*b*, and two mirror groups 29*a* and 29*b*. The optical writing unit 23 launches laser light corresponding to the inputted image data from the laser irradiation portions 28*a* and 28*b* respectively. Furthermore, the optical writing unit 23 irradiates these laser lights onto the photosensitive drum 21 via the mirror groups 29*a* and 29*b* to expose the uniformly charged surface of the photosensitive drum 21. Due to this, an electrostatic latent image can be formed on the surface of the photosensitive drum 21. Furthermore, here the optical writing unit 23 employs a two beam system provided with the two laser irradiation portions 28*a* and 28*b* to support high speed image forming processing, such that the irradiation timing is made faster, thereby allowing the load to be decreased.

It should be noted that instead of the laser scanning unit, an EL writing head or an LED writing head in which light-emitting elements are lined up in an array may be used as the optical writing unit 23.

The development apparatus 24 forms a toner image (also referred to as a visible image) on the surface of the photosensitive drum 21 by developing the electrostatic latent image that has been formed on the photosensitive drum 21 with a magnetic brush using the two-component developer (not shown in drawings) whose main components are toner and a magnetic carrier. Details of the development apparatus 24 are described later.

Here the transfer unit 25 is provided with a transfer belt 31, a drive roller 32, an idler roller 33, and an elastic conductive roller 34. The transfer belt 31 spans in a tensioned state these rollers 32 to 34 and other rollers. The surface of the transfer belt 31 moves due to rotation of these rollers 32 to 34, thereby transporting the recording material placed on that surface. The transfer belt 31 has a predetermined resistance value (for example, $1\times10^{9}$ to $1\times10^{13}$ Ω/cm). The elastic conductive roller 34 presses against the surface of the photosensitive drum 21 through the transfer belt 31. Due to this, the recording material on the transfer belt 31 can be pushed against the surface of the photosensitive drum 21. A transfer electric field having an opposite polarity to the charge of the toner image on the surface of the photosensitive drum 21 is applied to the elastic conductive roller 34. Due to this transfer electric field of an opposite polarity, the toner image on the surface of the photosensitive drum 21 can be transferred to the recording material on the transfer belt 31. For example, when the toner image has a charge of a negative (−) polarity, the polarity of the transfer electric field applied to the elastic conductive roller 34 is a positive (+) polarity.

Here the fixing unit 27 applies heat and pressure to the recording material to cause the toner image to thermally fix onto the recording material.

Specifically, the fixing unit 27 is provided with a hot roller 35 and a pressure roller 36. A heat source is provided inside the hot roller 35 in order to set the surface of the hot roller 35 to a predetermined temperature (fixing temperature: approximately 160° C. to 200° C.). Furthermore, a pressure-applying member not shown in the drawings is arranged at both ends of the pressure roller 36 so that the pressure roller 36 is pressed into contact with the hot roller 35 with a predetermined pressure. When the recording material is transported to a pressing portion (referred to as a fixing nip portion) between the hot roller 35 and the pressure roller 36, the fixing unit 27 subjects the unfixed toner image on the recording material to thermal melting and pressure while the recording material is being transported by the rollers 35 and 36. Due to this, the toner image can be fixed onto the recording material.

Here the cleaner unit 26 has a cleaning blade 26A that removes and collects toner that is residual on the surface of the photosensitive drum 21 after development and transfer.

A plurality of pairs of transport rollers 41 and a pair of registration rollers 42 are provided on the transport path 40 in order to transport the recording material. The pair of registration rollers 42 transports the recording material from the plurality of pairs of transport rollers 41 synchronized with the electrostatic latent image on the photosensitive drum 21.

The paper feed portion 105 is provided with a plurality of paper feed trays 51. Each of the paper feed trays 51 is a tray for storing a plurality of sheets of recording material and here are provided in a lower portion of the image forming apparatus 100.

Furthermore, at a lateral surface of the image forming apparatus 100 are provided a large capacity paper feed tray (LCC) 52, which is capable of storing large volumes of multiple types of recording material, and a manual paper feed tray 53 mainly for supplying recording material of nonstandard sizes or of small amounts. The discharge tray 47 is arranged at a lateral surface of an opposite side to the manual paper feed tray 53.

Figure 2:
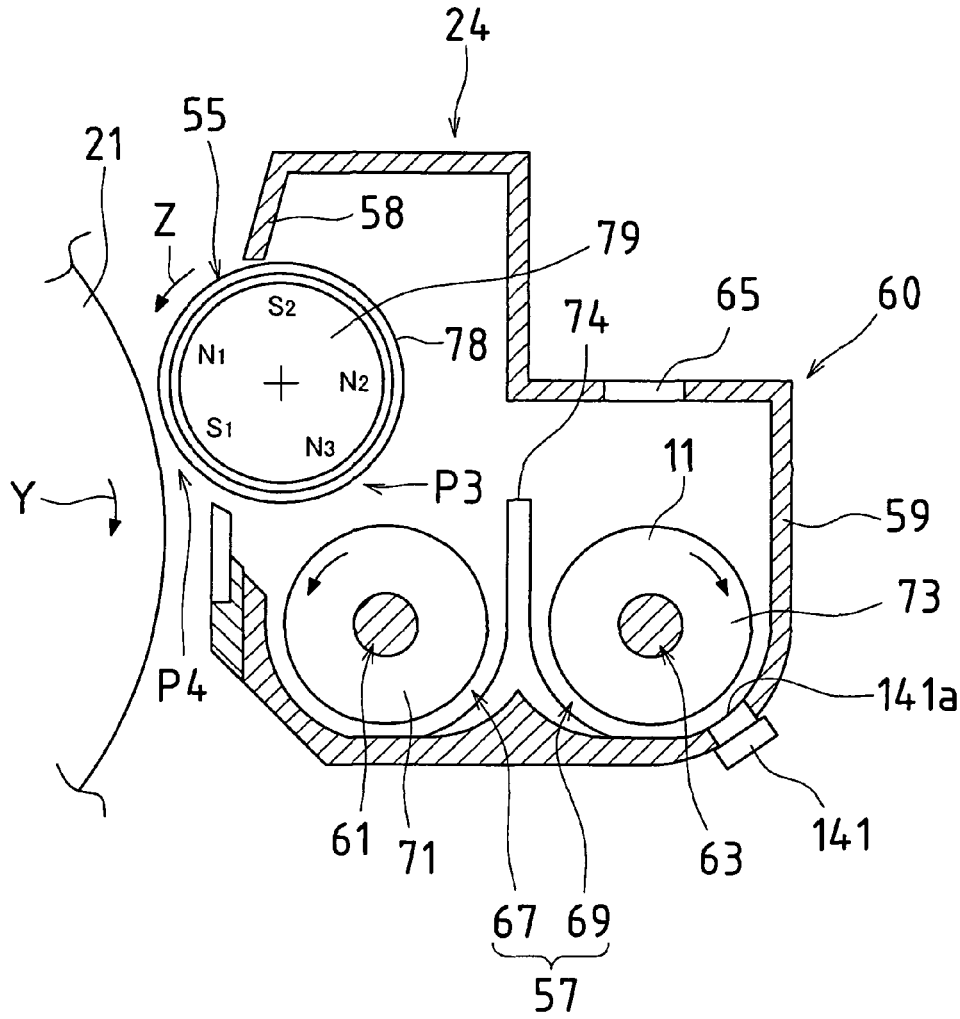
FIG. 2 is an outline cross-sectional view showing a development apparatus of the image forming apparatus according to the embodiment of the present invention as viewed laterally.
Figure 3:
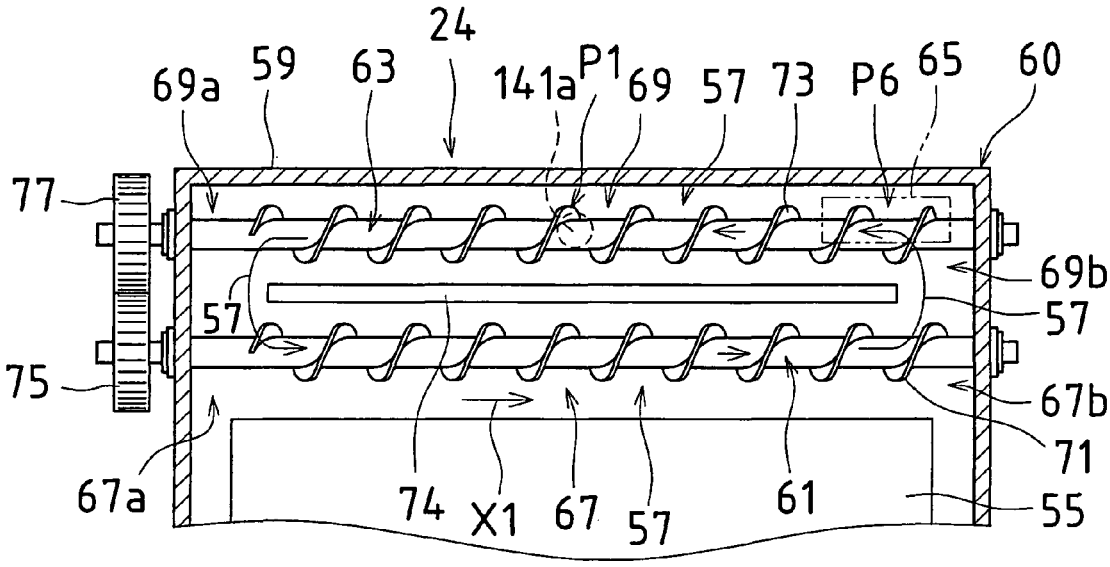
FIG. 3 is an outline cross-sectional view showing a development apparatus of the image forming apparatus according to the embodiment of the present invention as viewed from above.

Next, detailed description is given regarding the development apparatus 24. FIG. 2 and FIG. 3 are schematic cross-sectional views of the development apparatus 24 shown in FIG. 1. FIG. 2 shows the development apparatus 24 as viewed laterally, and FIG. 3 shows the development apparatus 24 as viewed from above.

As shown in FIG. 2 and FIG. 3, the development apparatus 24 is provided with a developer bearing member 55, a circulation transport portion 60, and a toner concentration detection sensor 141.

The developer bearing member 55 bears developer and here is configured as a development roller. The developer bearing member 55 is configured to bear developer on its surface and is rotationally driven at a predetermined fixed peripheral velocity Vd in a predetermined rotation direction (arrow Z in the diagram). In this way, the developer bearing member 55 can transport developer that is borne on its surface to a predetermined development position P4 at which the electrostatic latent image on the photosensitive drum 21 is to be developed.

Specifically, the developer bearing member 55 is provided with a cylindrical sleeve 78 constituted by nonmagnetic stainless steel, and a magnet roll 79 in which a magnetic pole N1 having an N pole, a magnetic pole S1 having an S pole, a magnetic pole N3 having an N pole, a magnetic pole N2 having an N pole, and a magnetic pole S2 having an S pole are arranged in order in a rotation direction Z around a circumferential portion. The magnet roll 79 is accommodated inside the sleeve 78. The sleeve 78 is rotatable relative to the magnet roll 79 and is rotationally driven in the arrow Z direction.

The circulation transport portion 60 circulates developer in a loop shape such that it is transported in a transport direction (X1 direction in the diagram) along an axial direction of the developer bearing member 55 while supplying developer at a predetermined supply position P3 on a circumferential surface of the developer bearing member 55.

Specifically, the circulation transport portion 60 is configured to supply developer to the developer bearing member 55 as well as to circulate the developer in a loop shape at a predetermined transport velocity Vs in the transport direction X1 of the developer bearing member 55.

In the present embodiment, the circulation transport portion 60 is provided with a first transport path 67, a second transport path 69, a first transport member 61, and a second transport member 63.

The first transport path 67 extends in the axial direction so as to supply developer to the developer bearing member 55. The second transport path 69 extends along the first transport path 67, and one end portion 69*a* thereof in the axial direction communicates with one end portion 67*a* in the axial direction of the first transport path 67, and another side 69*b* thereof communicates with another side 67*b* of the first transport path 67 so that along with the first transport path 67, the second transport path 69 forms a loop shape circulation transport path 57.

The first transport member 61 transports developer in the first transport path 67 from the one end portion 67*a* to the other side 67*b* in the axial direction. The second transport member 63 transports developer in the second transport path 69 from the other side 69*b* to the one end portion 69*a* in the axial direction.

And the circulation transport portion 60 is configured so that the first and second transport members 61 and 63 work together in the circulation transport path 57 formed by the first and second transport paths 67 and 69 to circulate developer.

Specifically, both end portions of the circulation transport path 57 communicate with each other and it is formed by the first transport path 67 and the second transport path 69 having an outward and return relationship, and the first transport path 67 is arranged so as to be in close vicinity to the developer bearing member 55. Here the first transport member 61 is configured as a first transport screw for transporting developer inside the first transport path 67 from the one end portion 67*a* to the other side 67*b* in the axial direction. And the second transport member 63 here is configured as a second transport screw for transporting developer inside the second transport path 69 from the other side 69*b* to the one end portion 69*a* in the axial direction.

The first transport screw 61, which rotates axially, is arranged in the first transport path 67. The second transport screw 63, which rotates axially, is arranged in the second transport path 69. The first and second transport screws 61 and 63 are provided with spiral fins 71 and 73 respectively, which are for transporting the developer and mixing the toner and carrier.

Furthermore, at one end portion, the first and second transport screws 61 and 63 are provided with drive gears 75 and 77 respectively that mesh with each other, and are thereby rotated by these in a reverse direction to each other. And the first and second transport screws 61 and 63 are rotationally driven along with the sleeve 78.

To describe this further, the development apparatus 24 is provided with a main body portion 59 that supports the developer bearing member 55. The main body portion 59 forms the circulation transport path 57 near the developer bearing member 55. The first and second transport paths 67 and 69, which form the circulation transport path 57, are formed by dividing the main body portion 59 using a partitioning plate 74 such that both end portions of the first and second transport paths 67 and 69 communicate. And the developer accommodated inside the main body portion 59 is circulated and transported inside the first and second transport paths 67 and 69.

The toner concentration detection sensor 141 detects the concentration of toner in the developer that circulates in the circulation transport portion 60. Specifically, the toner concentration detection sensor 141 is configured to detect the concentration of toner in the developer at a predetermined detection position P1 in the circulation transport portion 60. It should be noted that here the toner concentration detection sensor 141 is a magnetic permeability sensor that detects the carrier component in the developer, and is capable of detecting information relating to the concentration of toner in the developer.

In the present embodiment, the toner concentration detection sensor 141 is provided such that a detection portion 141*a* is positioned at the detection position P1 (here a central area in the axial direction) of the second transport path 69.

The image forming apparatus 100 is further provided with a toner replenishment apparatus 70 that replenishes toner to the developer in the development apparatus 24. The toner replenishment apparatus 70 is provided with tank that stores toner.

Toner replenishment to the developer is carried out at a predetermined replenishing position P6 in the second transport path 69. Specifically, a toner replenishment opening 65, into which toner to be replenished from the toner replenishment apparatus 70 is received, is formed at the replenishing position P6 (here the other end portion 69*b* in the axial direction) of the second transport path 69.

In the above-described development apparatus 24, developer that is transported in the transport direction X1 along the first transport path 67 is borne by the sleeve 78 by magnetic force of the magnetic poles formed by the magnet roll 79. On the sleeve 78 at this time, carrier is adsorbed by the magnetic force and toner is adsorbed by frictional electrification to the carrier that has been adsorbed.

The developer borne by the sleeve 78 is transported by the rotation direction Z rotation of the sleeve 78 and is moved to the development position P4 facing the surface of the photosensitive drum 21 in a state in which its layer thickness is regulated by a layer thickness regulating member 58 provided in the main body portion 59. Of the developer that has been moved to the development position P4, only the toner is electrostatically moved to the electrostatic latent image on the photosensitive drum 21 by a development bias voltage applied between the sleeve 78 and the photosensitive drum 21 in order to make visible (develop) the electrostatic latent image.

The developer that was used for development in this manner subsequently drops from the surface of the sleeve 78 at a repulsive magnetic field region formed by the magnetic poles N3 and N2 of the magnet roll 79, then returns to the first transport path 67 and is transported to the second transport path 69, thereby circulating in the circulation transport path 57. In regard to the developer that circulates in the circulation transport path 57, the concentration of its toner is detected by the toner concentration detection sensor 141 at the detection position P1 due to the toner replenishment control of the control portion 200, and its toner is replenished as required from the toner replenishment apparatus 70 by the toner replenishment opening 65 at the replenishing position P6. Toner replenishment control is described in detail later.

Figure 4:
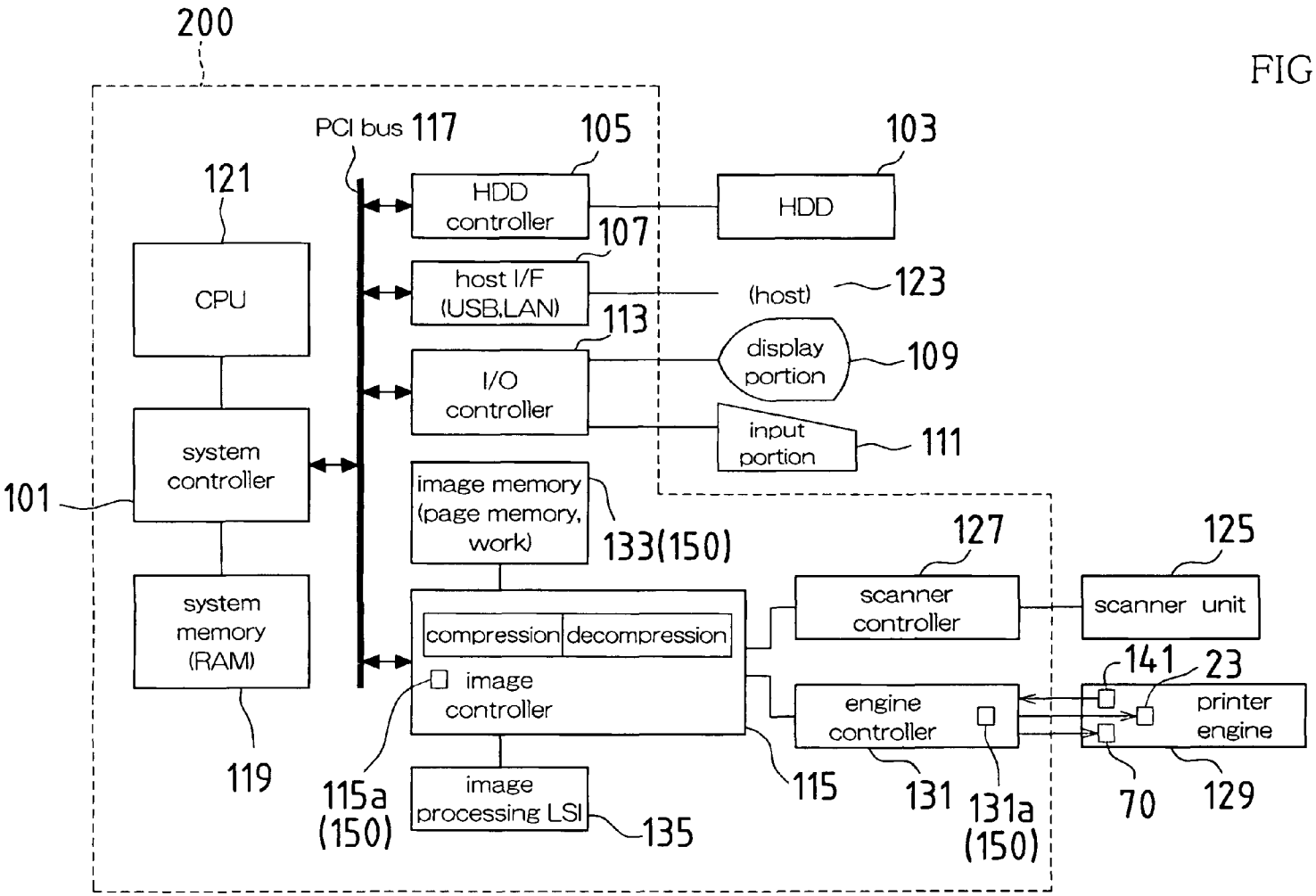
FIG. 4 is a block diagram showing an outline configuration of a control system of the image forming apparatus according to the embodiment of the present invention.

Next, description is given regarding a control system of the image forming apparatus 100 according to the present embodiment. FIG. 4 is a block diagram showing an outlined configuration of a control system of the image forming apparatus 100 according to the present embodiment.

As shown in FIG. 4, the control portion 200 is provided with a CPU (central processing unit) 121. It should be noted that an FPGA (field programmable gate array) may be used instead of the CPU 121. The storage portion 150 stores various control programs and necessary functions, and includes a ROM (read only memory) and a RAM (random access memory).

The control portion 200 is configured such that various control programs are read out from the storage portion 150 by the CPU 121 and control of image forming processes is carried out by executing the control programs that have been read out.

It should be noted that the toner concentration detection sensor 141 is connected to an input system of the control portion 200 such that its detection signals are inputted. Furthermore, the toner replenishment apparatus 70 is connected to an output system of the control portion 200 such that its operation signals are outputted.

Specifically, the control portion 200 is provided with a system controller 101, a HDD controller 105, a communications interface 107, an I/O controller 113, and an image controller 115. These control systems 101, 105, 107, 113, and 115 are connected to each other by a PCI bus 117.

The system controller 101 is connected to the CPU 121. The system controller 101 carries out transceiving of data signals and control signals and the like between each of the means that constitute the image forming apparatus 100, thereby performing overall control of operations including copying operations and printing operations. The various control programs are read out to a system memory 119 under the data transfer control of the system controller 101, and various types of control are achieved by executing these with the CPU 121.

The HDD controller 105 is connected to an external memory 103 provided in the image forming apparatus 100. Here the external memory 103 is a hard disk drive (hereinafter referred to as "HDD"). The HDD 103 is a large volume nonvolatile memory that stores processing data as required when performing such processing as processing of reading image data that has been read from an original and printer processing of image data. Furthermore, the HDD 103 is also capable of being used as a saving destination for image data that is sent from an external processing device in response to a request from an external processing device 123 capable of communicating with the image forming apparatus 100. Furthermore, the HDD controller 105 can carry out processing such as saving and deleting image data in the HDD 103.

The communications interface 107 is capable of connecting to the external processing device 123. The communications interface 107 is a communications interface means for receiving image data from the external processing device 123. When there is a request for image forming from the external processing device 123, the communications interface 107 executes image forming operations based on that information. Furthermore, the communications interface 107 is capable of sending image data that has been read by the scanner unit 125 to the external processing device 123.

The I/O controller 113 is connected to a display portion 109 and an input portion 111 provided in the image forming apparatus 100. The I/O controller 113 carries out input and output control of data in the display portion 109 and the input portion 111. The display portion 109 is provided with a display device that displays display information of the image forming apparatus 100. The display device can be configured as a liquid crystal display device or an LED lamp or the like.

The input portion 111 is provided with an input device for inputting input information of the image forming apparatus 100. The input device can be configured as a keyboard or a touch panel provided on a surface of a liquid crystal display device or the like.

The image controller 115 is connected to a scanner unit 125 via a scanner controller 127 and is also connected to a printer engine 129 via an engine controller 131. Furthermore, the image controller 115 is also connected to an image memory 133 and an image processing LSI 135.

The scanner controller 127 carries out control of scanning operations in the scanner unit 125.

The engine controller 131 receives detection signals from the toner concentration detection sensor 141 and other sensors, and controls the printer engine 129 by outputting control signals to the printer engine 129, which executes processing related to image forming. Furthermore, the engine controller 131 sends image data in accordance with the control signals to the optical writing unit 23 in the printer engine 129. The engine controller 131 sends operation signals, which operate the toner replenishment apparatus 70 in the printer engine 129, to the toner replenishment apparatus 70. It should be noted that the engine controller 131 is provided with a memory 131*a* in which is stored image data and measured toner concentration values, which are described later.

The image controller 115 carries out processing such as transfer processing for image data that has been read by the scanner unit 125, and transfer processing for data to be sent to the printer engine 129. Furthermore, the image controller 115 carries out various types of image processing concerning image data stored in the memory 115*a*, and also carries out processing such as compression, decompression, rotation and the like for the image data. The image controller 115 can be configured for example using an LSI or the like for high speed data processing.

The image memory 133 is for temporarily storing image data used in image forming by the printer engine 129, and includes a page memory in which memory regions storing image data are formed.

The image processing LSI 135 executes various types of image processing in order to form high image quality images using the printer engine 129, such as performing region separation processing on image data to be printed, filter processing for sharpening and smoothing appropriate to text regions and screened regions that have undergone region separation, color conversion from RGB to YMCK and black generation, and halftone processing such as dithering and error diffusion for reproducing the tones in the image of the original.

It should be noted that the storage portion 150 includes each of the aforementioned memories 131*a*, 115*a*, and 133.

Figure 5:
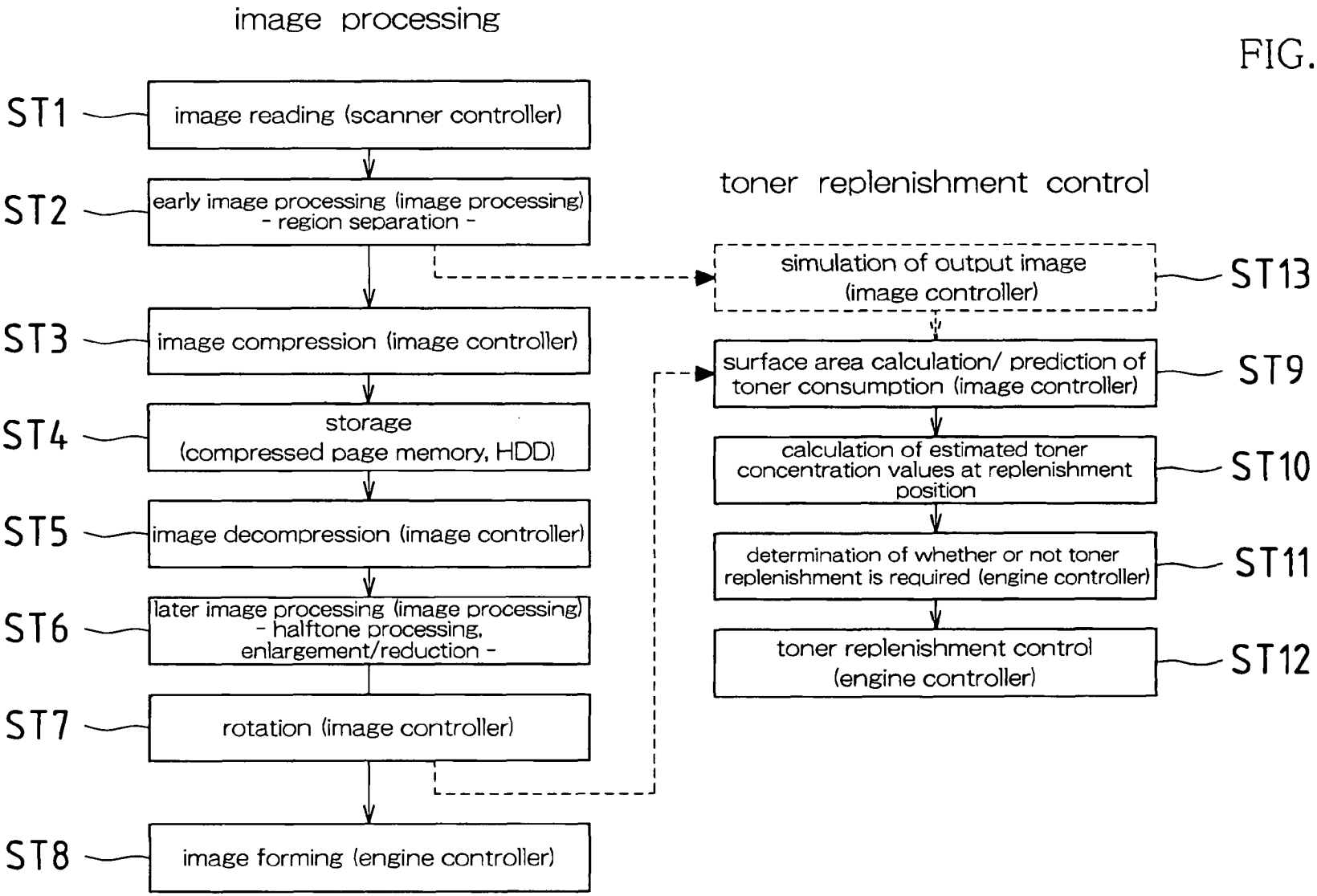
FIG. 5 is a diagram showing a flow of image data processing in a control portion of the image forming apparatus according to the embodiment of the present invention.

Next, description is given regarding a flow of image data processing in the control portion 200. FIG. 5 is a diagram showing a flow of image data processing in the control portion 200.

As shown in FIG. 5, in the control portion 200, when image data based on an image of the original that has been read by the scanner unit 125 is inputted (step ST1), the inputted image data first undergoes region separation processing by the image processing LSI 135 (ST2). Here, region separation processing refers to processing by which the pixels in the inputted image data are determined to be pertaining to one of a text region, a screened region, a photo region, or the like.

The image data that has undergone region separation processing then undergoes compression processing by the image controller 115 (ST3) and is temporarily stored in the image memory 133 (150) and/or the HDD 103 (ST4).

Compressed image data that has been stored in this manner then undergoes decompression processing by the image controller 115 (ST5) and is stored in page units in the image memory 133.

The image data that has undergone decompression processing then undergoes halftone processing when tones are to be reproduced by the image processing LSI 135, and undergoes enlargement processing or reduction processing based on specified settings when image enlargement or reduction has been specified (ST6), and also undergoes image rotation processing as required by the image controller 115 (ST7).

The image data that has been processing in this manner then undergoes image forming processing by the printer engine 129 due to the engine controller 131 (ST8).

Next, detailed description is given regarding toner replenishment control by the control portion 200 of the image forming apparatus 100 according to this embodiment of the present invention.

By executing the aforementioned control programs, the control portion 200 uses the toner concentration detection sensor 141 to measure the concentration of toner in the developer in the development apparatus 24 and predicts an amount of toner to be consumed based on the image data, thereby carrying out toner replenishment by estimating a toner concentration after development from a measured toner concentration value and a predicted toner consumption amount.

That is, the aforementioned control programs cause the control portion 200 to function as a means including a toner concentration measuring means, a storage means, a toner consumption amount predicting means, a toner concentration estimating means, and a toner replenishment control means.

Figure 6:
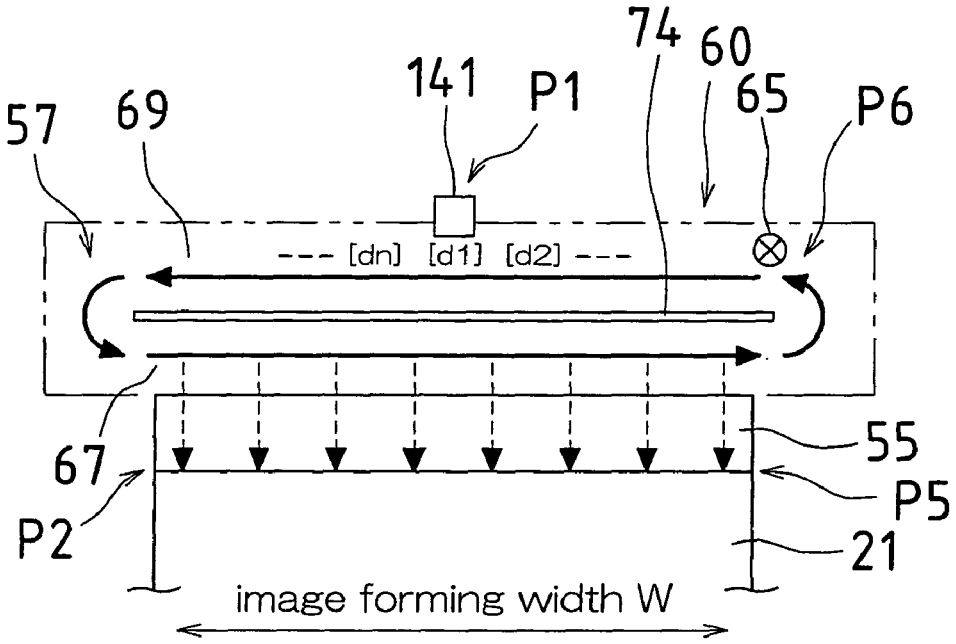
FIG. 6 is a top view schematically showing a circulation transport portion in which developer circulates in the image forming apparatus according to the embodiment of the present invention.
Figure 7:
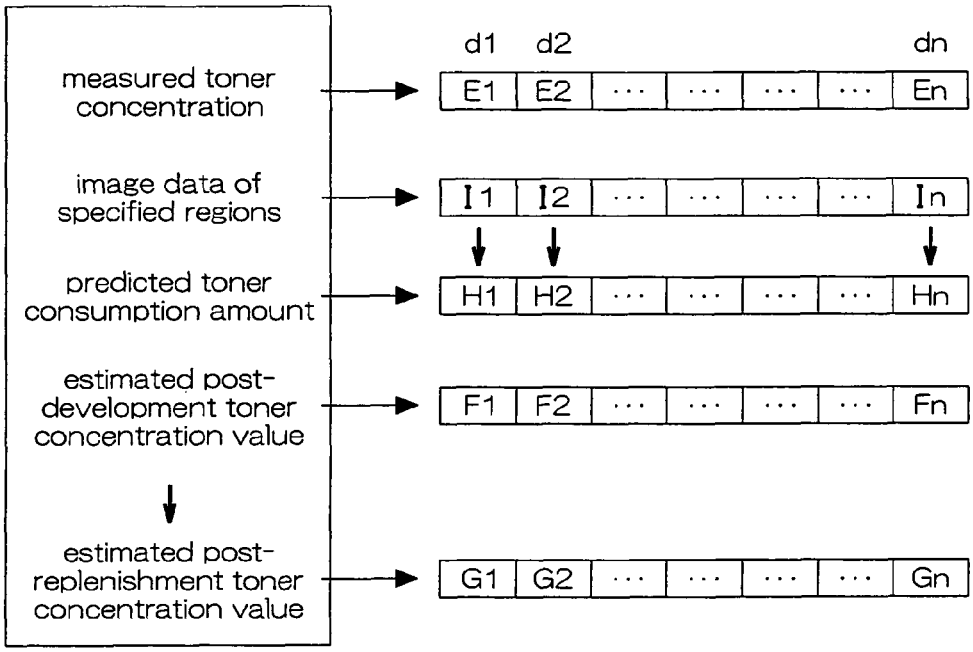
FIG. 7 shows a manner in which measured toner concentration values, predicted toner consumption amounts, estimated post-development toner concentration values, and estimated post-replenishment toner concentration values are written into a memory in the image forming apparatus according to the embodiment of the present invention.

FIG. 6 is a top view schematically showing the circulation transport portion 60 in which developer circulates. FIG. 7 shows a manner in which measured toner concentration values, predicted toner consumption amounts, estimated post-development toner concentration values, and estimated post-replenishment toner concentration values are written into a memory.

(Measuring Toner Concentrations)

The toner concentration measuring means measures the concentration of toner in the developer, which is detected by the toner concentration detection sensor 141, for each predetermined transport length along a developer transport direction X1.

Here, the toner concentration measuring means uses the toner concentration detection sensor 141 to measure the concentration of toner in the developer that circulates in the circulation transport portion 60 at the fixed transport velocity Vs for each predetermined setting time t1, t2, . . . , and tn. It should be noted that here the transport length is a length in which a one circuit length of the circulating developer has been divided by an integer n of 2 or greater. Furthermore, since the developer circulates, when the developer performs one circuit, n returns to 1.

(Storing Measured Toner Concentration Values)

The storage means stores in the storage portion 150 measured toner concentration values E1, E2, . . . , and En of developer d1, d2, . . . , and dn in each transport length measured by the toner concentration measuring means associated with the developer d1, d2, . . . , and dn in each transport length.

Here the storage means successively stores in the memory 131*a* (150) of the engine controller 131 the measured toner concentration values E1, E2, . . . , and En in the developer at each setting time t1, t2, . . . , and tn measured by the toner concentration measuring means associated with each setting time t1, t2, . . . , and tn.

(Predicting Amounts of Toner to be Consumed)

Among the image data stored in the storage portion 150, the toner consumption amount predicting means specifies regions of image data corresponding to the electrostatic latent image on the photosensitive drum 21 to be developed by the developer d1, d2, . . . , and dn in each transport length, and predicts toner consumption amounts H1, H2, . . . , and Hn of the corresponding developer d1, d2, . . . , and dn in each transport length based on image data I1, I2, . . . , and In of the specified regions corresponding to the developer d1, d2, . . . , and dn in each transport length that have been specified.

Here the toner consumption amount predicting means specifies regions of image data I1, I2, . . . , and In for the developer d1, d2, . . . , and dn in each transport length using a timing by which [developer] reaches the development position P4 from the supply position P3 while borne on the developer bearing member 55 that rotates at the peripheral velocity Vd and a timing by which the electrostatic latent image on the photosensitive drum 21 that rotates at the peripheral velocity Vc reaches the development position P4, while developer that is transported at the transport velocity Vs is transported along the transport direction X1 from the detection position P1 in the circulation transport portion 60 via an image forming commencement position P2 on an upstream side end of the developer bearing member 55 in the transport direction X1 to an image forming completion position P5 on a downstream side end.

(Estimating Toner Concentration after Development)

Based on the measured toner concentration values E1, E2, . . . , and En of the developer d1, d2, . . . , and dn in each transport length stored in the storage portion 150 by the storage means and the corresponding predicted toner consumption amounts H1, H2, . . . , and Hn of the developer d1, d2, . . . , and dn in each transport length predicted by the toner consumption amount predicting means, the toner concentration estimating means estimates toner concentrations F1, F2, . . . , and Fn in the developer after development using the corresponding developer d1, d2, . . . , and dn in each transport length.

Here the toner concentration estimating means successively reads out from the memory 131*a* the measured toner concentration values E1, E2, . . . , and En of the developer d1, d2, . . . , and dn in each transport length, which are stored in the memory 131*a* of the engine controller 131, then uses values ((E1-H1), (E2-H2), . . . (En-Hn)), in which the predicted toner consumption amounts H1, H2, . . . , and Hn of the developer d1, d2, . . . , and dn in each corresponding transport length are subtracted from the measured toner concentration values E1, E2, . . . , and En that have been read out, as estimated post-development toner concentration values F1, F2, . . . , and Fn, and successively stores these estimated post-development toner concentration values F1, F2, . . . , and Fn in the memory 131*a*.

(Toner Replenishment Control)

Based on the estimated post-development toner concentration values F1, F2, . . . , and Fn, of the developer d1, d2, . . . , and dn in each transport length estimated by the toner concentration estimating means and toner setting concentration values S that have been set in advance, the toner replenishment control means carries out toner replenishment control to the developer d1, d2, . . . , and dn for each corresponding transport length.

Here the toner replenishment control means specifies timings for replenishing toner to the developer d1, d2, . . . , and dn in each transport length according to a timing by which developer transported at the transport velocity Vs reaches the replenishing position P6 from the detection position P1 in the circulation transport portion 60.

Then, based on the estimated post-development toner concentration values F1, F2, . . . , and Fn, and the toner setting concentration values S, the toner replenishment control means determines whether or not to replenish toner to the developer d1, d2, . . . , and dn in each corresponding transport length and obtains the toner replenishment amounts when toner replenishment is to be carried out.

Specifically, the toner replenishment control means 118 compares the estimated post-development toner concentration values F1, F2, . . . , and Fn stored in the memory 131*a* and the toner setting concentration values S (control threshold), and when the estimated post-development toner concentration values F1, F2, . . . , and Fn is determined to be lower than the toner setting concentration value S, it replenishes toner from the toner replenishment apparatus 70 corresponding to that difference. For example, in a case where the toner replenishment apparatus 70 replenishes toner at a fixed amount per unit of time, the commencement timing and completion timing for toner replenishment can be controlled so that the toner replenishment amount corresponds to the difference of the estimated post-development toner concentration values F1, F2, . . . , and Fn subtracted from the toner setting concentration value S.

As described above, with the image forming apparatus 100 according to this embodiment of the present invention, the toner concentration detection sensor 141 is used, and corresponding estimated post-development toner concentration values F1, F2, . . . , and Fn are estimated according to the measured toner concentration values E1, E2, . . . , and En detected by the toner concentration detection sensor 141 and corresponding predicted toner consumption amounts H1, H2, . . . , and Hn that have been predicted from the image data I1, I2, . . . , and In of the specified regions, and since toner replenishment control is carried out to the corresponding developer based on the estimated post-development toner concentration values F1, F2, . . . , and Fn that have been estimated and the toner setting concentration values S, it becomes possible to carry out control of toner replenishment to the developer with excellent accuracy conforming to the image data corresponding to the electrostatic latent image on the photosensitive drum 21 to be developed by the developer.

To give further description regarding the present embodiment, the toner concentration detection sensor 141 in the present embodiment is arranged on a downstream side of the developer transport direction X1 from the position P6 at which toner is replenished to the developer.

Then, in the present embodiment, based on the replenishment amount of toner to the developer d1, d2, . . . , and dn to be replenished in each transport length by the toner replenishment control means, the toner concentration estimating means estimates toner concentrations G1, G2, and Gn in the developer after toner replenishment to the developer d1, d2, and dn in each corresponding transport length, then differences ((G1-E1), (G2-E1), . . . , (Gn-En)), which are obtained by comparing the estimated post-replenishment toner concentration values G1, G2, . . . , and Gn estimated for the developer d1, d2, . . . , and dn in each transport length and the measured toner concentration values E1, E2, . . . , and En of the developer d1, d2, . . . , and dn in each corresponding transport length as measured by the toner concentration measuring means after toner has been replenished by the toner replenishment control means, are added for a predetermined number of samples (for example, one circuit of the circulating developer).

Then, based on the added values that have obtained by the addition by the toner concentration estimating means, the toner replenishment control means adjusts the toner setting concentration values S.

Furthermore, in the present embodiment, the toner concentration estimating means carries out an averaging process on the estimated post-development toner concentration values F1, F2, . . . , and Fn and the estimated post-replenishment toner concentration values G1, G2, . . . , and Gn that have been estimated for the developer d1, d2, . . . , and dn in each transport length.

Figure 8:
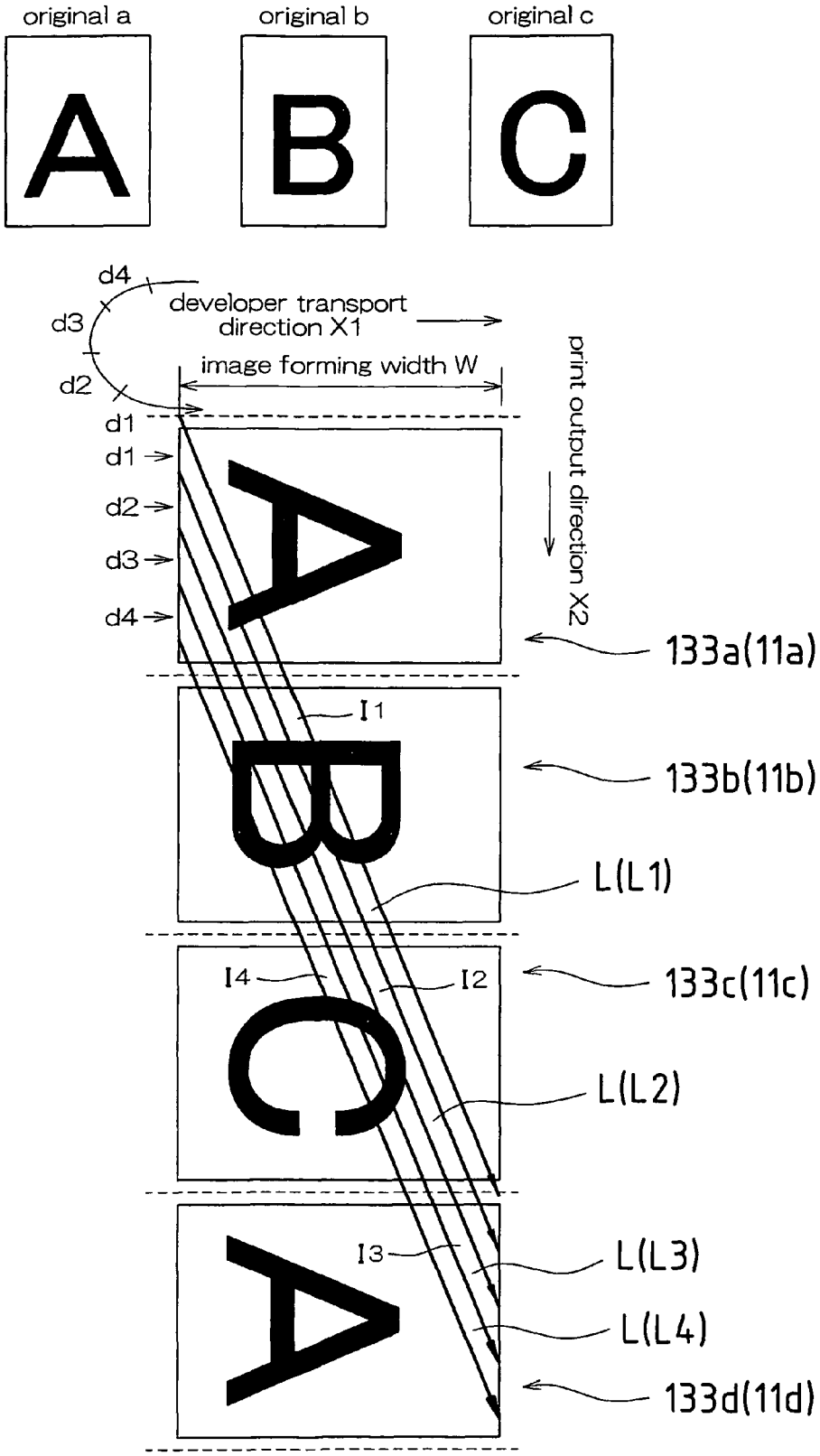
FIG. 8 is a schematic diagram showing image regions in which toner of the developer in each transport length is consumed in the image forming apparatus according to the embodiment of the present invention.

Next, description is given regarding a specific operation in which toner is replenished to the developer with reference to FIG. 5 to FIG. 8. FIG. 8 is a schematic diagram showing image regions in which toner of the developer d1, d2, . . . , and dn in each transport length is consumed.

In carrying out toner replenishment operations in the image forming apparatus 100 according to the present embodiment, first the toner concentration detection sensor 141 measures the concentration of toner in the developer that circulates in the circulation transport path 57 for each of the predetermined setting times t1, t2, . . . , and tn. That is, the toner concentration detection sensor 141 can detect in order the toner concentration in each developer block d1, d2, . . . , and dn, in which the circulating developer is virtually divided into an n number of blocks having a same length in the transport direction X1.

It should be noted that in detecting the toner concentrations, it is possible to use as a representative value a detection value detected one time in the developer blocks d1, d2, . . . , and dn, and it is also possible to use as a representative value an averaged value of multiple times of detection.

As shown in FIG. 7, in the memory 131*a* of the engine controller 131, a memory region is formed in which are written the measured toner concentration values E1, E2, . . . , and En of the developer blocks d1, d2, . . . , and dn for one circuit detected by the toner concentration detection sensor 141. Memory regions are formed in a same manner for values obtained thereon. It should be noted that only values necessary for processing are maintained in the memory regions formed in the memory, and values that are no longer necessary for processing are successively overwritten.

Here these memory regions are provided in the engine controller 131, but there is no limitation to this. For example, a portion of the memory 115*a* (150) in the image controller 115 may be used, and it is also possible to use a portion of the image memory 133 (150).

Next, the amount of toner to be consumed in the developer consumed while the developer blocks d1, d2, . . . , and dn perform one circuit of the circulation transport path 57 is predicted based on the image data corresponding to the electrostatic latent image to be developed by the developer. It should be noted that the image data includes data and the like obtained by receiving from an external processing device connected to the image forming apparatus 100 in addition to data obtained by scanning an original using the image scanner unit 125.

Toner is consumed when the developer blocks d1, d2, . . . , and dn pass over a width (image forming width) W in which toner is supplied from the first transport path 67 in the circulation transport path 57 to the developer bearing member 55. Furthermore, when the developer blocks d1, d2, and dn pass over the image forming width W, toner is consumed in regions along diagonal lines L1, L2, . . . , and Ln for images 11*a*, 11*b*, and so on corresponding to the electrostatic latent image on the rotating photosensitive drum 21 as shown in FIG. 8. That is, the lines L1, L2, . . . , and Ln are development trajectory virtual lines along which the developer blocks d1, d2, . . . , and dn move on the photosensitive drum 21 when development is carried out. The tilt of the lines L is determined according to the transport velocity Vs of the developer and the velocity Vc by which the electrostatic latent image is formed on the photosensitive drum 21 (the peripheral velocity of the photosensitive drum 21 (image forming velocity)).

The image data stored in the image memory 133 is written by the optical writing unit 23 with a predetermined timing onto the photosensitive drum 21 as an electrostatic latent image. The electrostatic latent image that has been written is made into a visible image by receiving toner from the developer bearing member 55. On the other hand, the developer bearing member 55 that has supplied toner to the photosensitive drum 21 receives toner supply from the developer that is transported in the first transport path 67.

For this reason, toner is consumed from the developer blocks in which positions corresponding to the electrostatic latent image on the rotating photosensitive drum 21 are being transported in the developer transport direction X1 with a timing by which a time required for photosensitive drum 21 rotation after the electrostatic latent image has been written onto the photosensitive drum 21 by the optical writing unit 23 until toner supply from the developer bearing member 55 is received and a time required for developer bearing member 55 rotation until the developer bearing member 55 that has supplied toner to the photosensitive drum 21 receives toner supply from the developer transported in the first transport path 67 have elapsed.

Accordingly, depending on the timing by which the developer blocks d1, d2, . . . , and dn pass over the image forming width W, it is possible to specify which line for the corresponding region among the development trajectory virtual lines L1, L2, . . . , and Ln of the images 11*a*, 11*b*, and so on corresponding to the electrostatic latent image on the photosensitive drum 21.

Furthermore, in regard to the image data 133*a*, 133*b*, and so on corresponding to the originals a, b, and c in the image memory 133 to be written on the photosensitive drum 21 as electrostatic latent images, it is possible to specify the regions of image data within the image memory 133 along the development trajectory virtual lines L1, L2, . . . , and Ln corresponding to the developer blocks d1, d2, . . . , and dn.

Consequently, based on the image data I1, I2, . . . , and In corresponding to the specified regions of the developer blocks d1, d2, . . . , and dn that have been specified, it is possible to predict the amount of toner to be consumed in the corresponding developer blocks d1, d2, . . . , and dn. In other words, the amount of toner to be consumed when the developer blocks d1, d2, . . . , and dn are to pass over the image forming width W can be predicted based on the image data I1, 12, . . . , and In of the corresponding specified regions in the image memory 133.

For example, suppose that at the developer transport velocity Vs, the developer performs one circuit of the circulation transport path 57, which is formed by the first transport path 67 and the second transport path 69, in 22 seconds, and that the developer blocks d1, d2, . . . , and dn pass over the image forming width W in 9 seconds. Furthermore, suppose that 20 sheet portions of electrostatic latent images are formed in one minute (that is, three sheets of originals in 9 seconds) on the rotating photosensitive drum 21 as the image forming velocity, and that originals a, b, and c on which are placed the letters "A," "B," and "C" undergo image forming in multiple sorted lots (collated units) as shown in FIG. 8.

In this case, toner is consumed in regions along the diagonal development trajectory virtual lines L1, L2, . . . , and Ln respectively for the electrostatic latent images of the three sheets of originals formed on the photosensitive drum 21 as shown in FIG. 8 when the developer blocks d1, d2, . . . , and dn pass over the image forming width W, that is, during the 9 seconds for passing the image forming width W. It should be noted that although there are also blocks in which toner is consumed for the fourth image as shown in the developer blocks corresponding to the line L2 and line L3, the length of each line L is the same. Accordingly, under the aforementioned conditions, the lines L1, L2, . . . , and Ln essentially have a length of diagonal line on three sheets of originals lined up separately.

And in the developer blocks d1, d2, . . . , and dn, toner is consumed in areas that overlap between the corresponding development trajectory virtual lines L1, L2, . . . , and Ln and portions concerned with toner consumption in the image data 133*a*, 133*b*, and so on corresponding to the originals a, b, and c, which in the illustrated example are the areas that overlap between the text portions of "A," "B," and "C" of the original a, original b, and original c in FIG. 8 and the lines L. Accordingly, the amount of toner to be consumed in a development trajectory virtual line L shown in FIG. 8 when a single developer block d passes over the image forming width W can be predicted from the image data I.

For example, the amount of toner to be consumed in the developer block d1 corresponding to the development trajectory virtual line L1 shown in FIG. 8 is predicted based on the image data I1 corresponding to the specified regions among the image data 133*a*, 133*b*, and so on corresponding to the originals a to c.

Specifically, the image controller 115 calculates ratios (rates of area) of the areas to which toner is to be made to adhere to the area of the original based on the image data I1, I2, . . . , and In corresponding to the specified regions among the image data 133*a*, 133*b*, and so on of the originals a, b, and c after image processing, which have been saved in the image memory 133 as shown in FIG. 5, and from these rates of area toner consumption amounts H1, H2, . . . , and Hn are predicted (ST9) in the development trajectory virtual lines L1, L2, . . . , and Ln for the corresponding developer blocks d1, d2, . . . , and dn. It should be noted that the predicted toner consumption amounts H1, H2, . . . , and Hn can be obtained for example by multiplying an amount of toner that adheres per single pixel by a total number of pixels relating to toner consumption among pixels in the image data corresponding to the development trajectory virtual lines L1, L2, . . . , and Ln.

Then, the corresponding predicted toner consumption amounts H1, H2, . . . , and Hn are subtracted from the measured toner concentration values E1, E2, . . . , and En detected by the toner concentration detection sensor 141 for the developer blocks d1, d2, . . . , and dn, thereby calculating (ST10) the estimated post-development toner concentration values F1, F2, . . . , and Fn of the corresponding developer blocks d1, d2, . . . , and dn at the replenishing position P6, and these are written to the memory 131*a*.

In the present embodiment, an averaging process is carried out before writing when writing the estimated post-development toner concentration values of the developer blocks d1, d2, . . . , and dn.

When the estimated post-development toner concentration values F1, F2, . . . , and Fn are set as a function f(i) (i=1 to n) for example, this averaging process may be carried out by calculating an averaged f(i) from formula (1) below using proximal estimated post-development toner concentration values including the estimated post-development toner concentration value f(i) targeted for processing.

[Formula 1]

$$f(i)(\text{after averaging}) = \frac{\{f(i-j)+\ldots+f(i)+\ldots+f(i+j)\}}{2j+1} \quad (1)$$

Or the averaging process may be carried out by calculating the averaged f(i) by a convolution operation of formula (2) below using a distribution function q(j).

[Formula 2]

$$f(i)(\text{after averaging}) = \sum_j f(j)\cdot q(i\cdot j) \quad (2)$$

By averaging and writing to the memory 131*a* the estimated post-development toner concentration values F1, F2, . . . , and Fn of the developer blocks d1, d2, . . . , and dn in this manner, it becomes possible to reflect in the estimated post-development toner concentration values F1, F2, . . . , and Fn the averaging of the toner concentrations by an agitation effect or the like during transport of the developer that actually circulates in the circulation transport portion 60.

Next, the engine controller 131 determines whether or not toner replenishment is required (ST11) from the estimated post-development toner concentration values F1, F2, . . . , and Fn that have been written to the memory 131*a*.

The engine controller 131 compares the estimated post-development toner concentration values F1, F2, . . . , and Fn of the developer blocks d1, d2, . . . , and dn and the toner setting concentration value S (control threshold), and when the estimated post-development toner concentration values F1, F2, . . . , and Fn are determined to be lower than the toner setting concentration value S, it replenishes toner from the toner replenishment apparatus 70 corresponding to that difference.

Furthermore, based on the developer transport velocity Vs, the engine controller 131 measures the time for the developer blocks d1, d2, . . . , and dn, whose toner concentrations are detected by the toner concentration detection sensor 141, to reach the replenishing position P6, and aligns the timings of the detection position P1 of toner concentrations detected by the toner concentration detection sensor 141 and toner replenishment at the replenishing position P6. Then, the engine controller 131 aligns (ST12) the timings of commencement and completion of replenishment so that the toner replenishment amount corresponds to the difference of the estimated post-development toner concentration values F1, F2, . . . , and Fn subtracted from the toner setting concentration value S.

It should be noted that image data immediately prior to printing saved in the image memory 133 is used here when the amount of toner to be consumed is predicted. However, as shown in FIG. 5, the image controller 115 may perform a simulation (ST13) of the output image data from image data that has undergone region separation, and the amount of toner to be consumed may also be predicted in a same manner as above based on this.

In the present embodiment, post-replenishment toner concentrations G1, G2, . . . , and Gn are estimated for the developer blocks d1, d2, . . . , and dn, then the estimated values G1, G2, . . . , and Gn and the measured toner concentration values E1, E2, . . . , and En detected by the toner concentration detection sensor 141 are compared, thereby adjusting the toner setting concentration values S.

Here, as described earlier, the measured toner concentration values E1, E2, . . . , and En of the developer blocks d1, d2, . . . , and dn are measured by the toner concentration detection sensor 141, and the estimated post-development toner concentration values F1, F2, . . . , and Fn are estimated by subtracting the predicted toner consumption amounts H1, H2, . . . , and Hn from the measured toner concentration values E1, E2, . . . , and En, such that whether or not toner is to be replenished and the replenishment amounts thereof are determined based on the estimated post-development toner concentration values F1, F2, . . . , and Fn. Then, the estimated post-replenishment toner concentration values G1, G2, . . . , and Gn of the developer blocks d1, d2, . . . , and dn after toner replenishment can be estimated for example by adding the replenishment amounts to the estimated post-development toner concentration values F1, F2, . . . , and Fn. Here, in the present embodiment, after [the developer blocks] pass the toner concentration detection sensor 141, are used for development, and pass the replenishing position P6, the toner concentrations of the developer blocks d1, d2, . . . , and dn that again pass the toner concentration detection sensor 141 should be at the toner setting concentration value S.

From this perspective, in the present embodiment, a comparison is performed between the estimated post-replenishment toner concentration values G1, G2, . . . , and Gn of the developer blocks d1, d2, . . . , and dn and the corresponding measured toner concentration values E1, E2, . . . , and En, which are detected by the toner concentration detection sensor 141 after toner has been replenished by the toner replenishment control means and measured by the toner concentration measuring means. Then the differences that have been compared are added over one circuit for example, and the toner setting concentration values S are altered in response to the added value. Specifically, when the obtained added value is positive, the toner setting concentration value S can be lowered, and when the obtained added value is negative, the toner setting concentration value S can be raised.

By comparing the estimated post-replenishment toner concentration values G1, G2, . . . , and Gn of the developer blocks d1, d2, . . . , and dn and the measurement results of the toner concentration detection sensor 141 in this manner, it is possible to automatically correct errors in the toner replenishment amounts.

It should be noted that it is also possible to carry out, before a comparison with the measured toner concentration values E1, E2, . . . , and En, an averaging process on the estimated post-replenishment toner concentration values G1, G2, . . . , and Gn. In this case, processing can be carried out in a same manner as the above-described averaging process for the estimated post-development toner concentration values F1, F2, . . . , and Fn for example.

Furthermore, in the present embodiment, in predicting the toner consumption amount, it is also possible to divide the images corresponding to the electrostatic latent image on the photosensitive drum 21 into rectangular image blocks.

Figure 9:
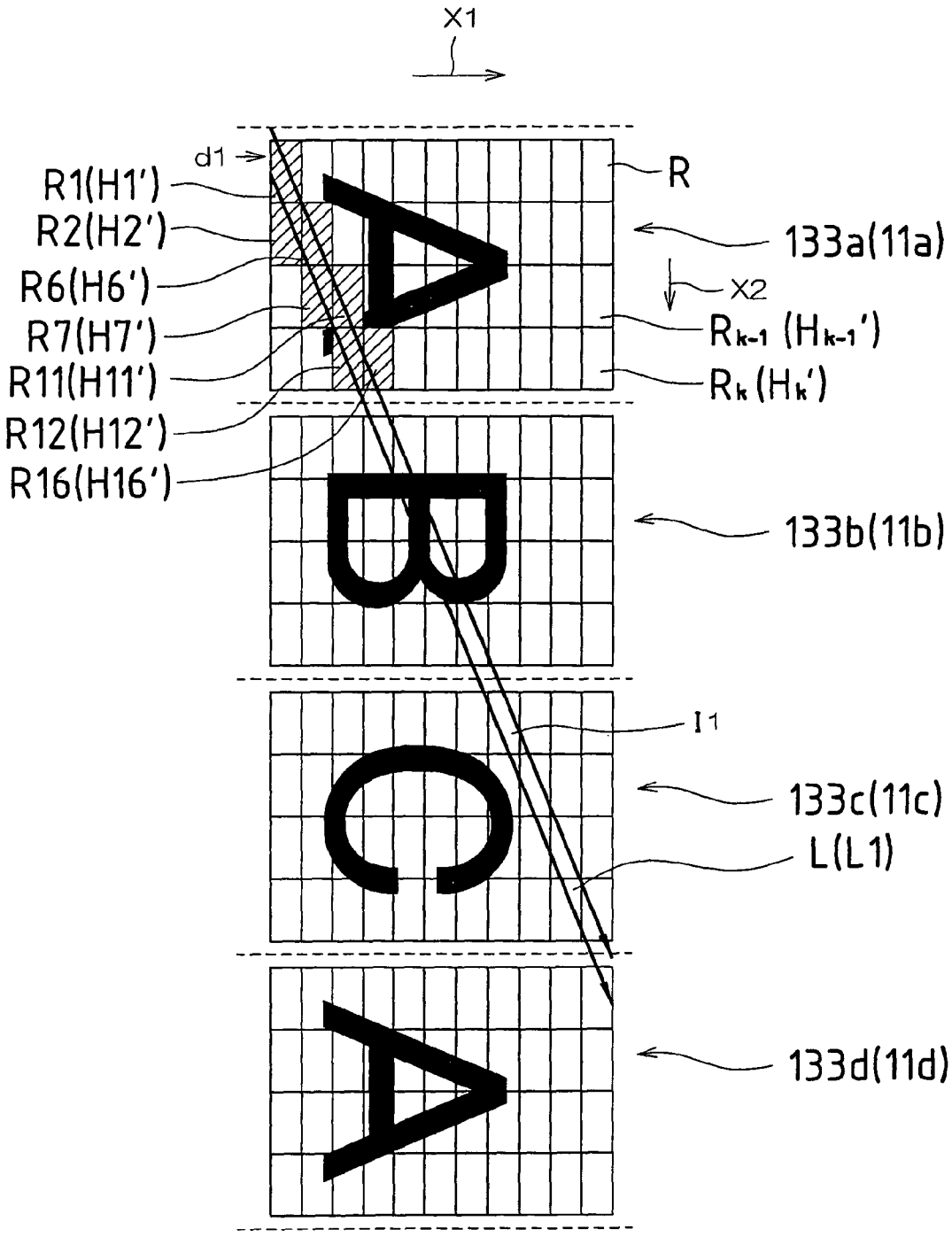
FIG. 9 is an explanatory diagram of a case where post-development toner consumption amounts are predicted by dividing the image corresponding to the electrostatic latent image on the photosensitive drum into rectangular blocks in the image forming apparatus according to an embodiment of the present invention.

FIG. 9 is an explanatory diagram of a case where post-development toner consumption amounts are determined by dividing the image corresponding to the electrostatic latent image on the photosensitive drum 21 into rectangular blocks.

In the present embodiment, as shown in FIG. 9, the toner consumption amount predicting means performs a k1 (here k1 is an integer of 2 or greater) division in the developer transport direction X1 on the regions of the images 11*a*, 11*b*, and so on corresponding to the electrostatic latent image on the photosensitive drum 21, which are formed based on the image data 133*a*, 133*b*, and so on stored in the storage portion 150, and performs a k2 (here k2 is an integer of 2 or greater) division in a direction (print output direction) X2 that intersects perpendicularly to the developer transport direction X1, thereby dividing rectangular image blocks R, and based on image data corresponding to image blocks R1, R2, . . . , and Rk (k=k1×k2) that have been divided, toner consumption amounts H1', H2', . . . and Hk' of developer to be consumed in the image blocks R1, R2, . . . , and Rk are predicted, and the estimated toner consumption amounts H1, H2, . . . , and Hn of the corresponding developer blocks d1, d2, . . . , and dn are determined based on the estimated toner consumption amounts H1', H2', . . . , and Hk' of the image blocks R1, R2, . . . , and Rk corresponding to the image data I1, I2, . . . , and In of the specified regions of the developer blocks d1, d2, . . . , and dn.

Specifically, the toner consumption amount predicting means sets the predicted toner consumption amounts H1, H2, . . . , and Hn (for example, H1) of the developer blocks d1, d2, . . . , and dn (for example, d1) as a total predicted toner consumption amount (for example, H1'+H2'+H6'+H7'+H11'+H12'+H16'+ . . . ) of image blocks R1, R2, . . . , Rk (for example, R1, R2, R6, R7, R11, R12, R16, . . . ) corresponding to specified region image data I1, I2, . . . , In (for example, I1) for the corresponding developer blocks d1, d2, and dn (for example, d1), thereby obtaining predicted toner consumption amounts H1, H2, . . . , and Hn (for example, H1) of the corresponding developer blocks d1, d2, . . . , and dn (for example, d1).

To further describe this specifically, the images 11*a*, 11*b*, and so on corresponding to the originals a to c are divided into rectangular image blocks R1, R2, . . . , and Rk as shown in FIG. 9, and toner consumption amounts H1', H2', . . . , and Hk' of the image blocks R1, R2, . . . , and Rk are predicted. Then, the toner consumption amounts of each of the blocks R is predicted by adding the toner consumption amounts of the image blocks R on the line L corresponding to the blocks R.

Furthermore, when predicting the toner consumption amounts of the image blocks R1, R2, . . . , and Rk, the accuracy of the predictions can be increased by performing multiplication using a coefficient corresponding to the lengths by which the development trajectory virtual lines L1, L2, . . . , and Ln pass on the image blocks R1, R2, . . . , and Rk.

That is, a coefficient K corresponding to an overlap extent, by which the development trajectory virtual lines L1, L2, . . . , and Ln and the image blocks R1, R2, . . . , and Rk overlap, is set in advance for each of the image blocks, and the toner consumption amount predicting means multiplies the predicted toner consumption amounts (for example, H1', H2', H6', H7', H11', H12', H16', . . . ) of the image blocks R1, R2, . . . , and Rk (for example, R1, R2, R6, R7, R11, R12, R16, . . . ) that overlap the development trajectory virtual lines L1, L2, . . . , and Ln (for example, L1) of the developer blocks d1, d2, . . . , and dn (for example, d1) by the coefficients K (for example, 0.8, 0.4, 0.8, 0.7, 0.6, 0.8, and 0.2), which correspond to the overlap extent with the image blocks, and by totaling the thus-obtained values (for example, 0.8×H1'+0.4×H2'+0.8×H6'+0.7×H7'+0.6×H11'+0.8×H12'+0.2×H16'+ . . . ), the predicted toner consumption amounts are obtained for the corresponding developer blocks d1, d2, . . . , and dn (for example, d1).

To further describe this specifically, it is possible to set to 1 the coefficient for when the development trajectory virtual lines L1, L2, . . . , and Ln pass through diagonal lines of the rectangular image blocks R1, R2, and Rk as shown in FIG. 9, then use this as a reference to vary the coefficients corresponding to the length by which they pass through the image blocks R1, R2, . . . , and Rk. For example, in a case where the overlap with the line L1 is long as in the image blocks R1 and R6, it becomes a large coefficient close to 1, and in a case where the overlap with the line L1 is short as in the image block R16, it becomes a small coefficient. In this manner, by dividing the images 11*a*, 11*b*, and 11*c* corresponding to the originals a, b, and c into the rectangular image blocks R1, R2, . . . , and Rk, and obtaining the predicted toner consumption amounts H1, H2, . . . , and Hn from the image data corresponding to the image blocks R1, R2, . . . , and Rk, the toner consumption amounts can be predicted using simple arithmetic processing.

It should be noted that when predicting the toner consumption amounts of the image blocks R1, R2, . . . , and Rk, as described earlier, these can be obtained by multiplying an amount of toner that adheres per single pixel by a total number of pixels relating to toner consumption among pixels in the image data corresponding to the image blocks R1, R2, . . . , and Rk. Furthermore, it is also possible to correct the amount of toner that adheres by referencing a table based on a plurality of patterns giving consideration to an influence of adjacent pixels.

Furthermore, in the present embodiment, the toner consumption amount predicting means sets the time of one circuit of developer that circulates in the circulation transport portion 60 of the development apparatus 24 as an integral multiple of the time required for a single cycle (one sheet) of image forming.

By setting the time of one circuit of developer as an integral multiple of the time required for image forming in a single cycle in this manner, the positions at which the lines L1, L2, . . . , and Ln pass over the image blocks R1, R2, . . . , and Rk can be specified by matching to each integral multiple of time required for a single cycle of image forming, and therefore the coefficients for the one circuit of developer can be specified. This enables groupings in which image blocks are accumulated to be reduced, and the arithmetic processing for obtaining predicted toner consumption amounts of the developer blocks d1, d2, . . . , and dn can be simplified by an equivalent proportion.

The image forming apparatus 100 according to this embodiment of the present invention is not limited to the configuration of the foregoing embodiment, and may be modified as appropriate.

For example, in the present embodiment, description was given regarding image data that has been read from the scanner unit 125, but image data may also be sent from the external processing device 123. Furthermore, the memory for saving the toner concentration values and the like may be provided in the image controller 115, and the image memory 133 may also be used. Further still, it is not absolutely necessary to divide off memory regions into which toner concentration values and predicted toner consumption amounts are written, and for example measured toner concentration values and estimated toner concentration values may both be overwritten to data thereof that has become unnecessary using a ring buffer arranged in a conceptual ring shape.

The present invention can be implemented in a variety of other forms without departing from its spirit or essential features. For this reason, the above-described embodiments are to all intents and purposes merely illustrative and should not be construed as limiting. The scope of the present invention is defined by the claims and is not restricted by the descriptions of the specification in any way. Furthermore, all variations and modifications of the claims within the scope of equivalency fall within the purview of the present invention.

What claimed is:

1. An image forming apparatus comprising a storage portion, an image bearing member on which an electrostatic latent image is to be formed based on image data stored in the storage portion, and a development apparatus that develops the electrostatic latent image formed on the image bearing member as a toner image using a two-component developer including toner and a carrier, wherein the development apparatus is provided with:

a developer bearing member that bears the developer, a circulation transport portion that circulates the developer in a loop shape such that the developer is transported in a transport direction along an axial direction of the developer bearing member while being supplied to a circumferential surface of the developer bearing member, and a toner concentration detection sensor that detects a concentration of toner in the developer that circulates in the circulation transport portion, and is configured to carry out replenishment of toner to the developer in the circulation transport portion, wherein the image forming apparatus is provided with:

a toner concentration measuring means that measures the concentration of toner in the developer, which is detected by the toner concentration detection sensor, for each predetermined transport length along the developer transport direction, a storage means that stores in the storage portion a measured toner concentration value of the developer in each transport length measured by the toner concentration measuring means, a toner consumption amount predicting means that specifies, among image data stored in the storage portion, regions of the image data corresponding to the electrostatic latent image on the image bearing member to be developed by the developer in each transport length, and predicts toner consumption amounts of the developer in each corresponding transport length based on image data of the specified regions for the developer in each transport length that has been specified, a toner concentration estimating means that, based on the measured toner concentration values of the developer in each transport length stored in the storage portion by the storage means and the predicted toner consumption amounts of the developer in each corresponding transport length predicted by the toner consumption amount predicting means, estimates toner concentrations in the developer after development using the developer in each corresponding transport length, and a toner replenishment control means that, based on the estimated post-development toner concentration values of the developer in each transport length estimated by the toner concentration estimating means and a toner setting concentration value that has been set in advance, carries out control of toner replenishment to the developer in each corresponding transport length.

2. The image forming apparatus according to claim 1, wherein the circulation transport portion comprises:

a first transport path extending in the axial direction so as to supply the developer to the developer bearing member, a second transport path that extends along the first transport path and communicates with the first transport path so as to form with the first transport path a loop shape circulation transport path, a first transport member that transports the developer in the first transport path from a one side to another side of the axial direction, and a second transport member that transports the developer in the second transport path from the other side to the one side of the axial direction, and is configured so that the first and second transport members work together in the circulation transport path formed by the first and second transport paths to circulate the developer, wherein the toner concentration detection sensor is provided in the second transport path and toner replenishment to the developer is carried out in the second transport path.

3. The image forming apparatus according to claim 1, wherein the toner concentration detection sensor is arranged on a downstream side in the developer transport direction from a position at which toner is replenished to the developer, based on a replenishment amount of toner to the developer to be replenished in each transport length by the toner replenishment control means, the toner concentration estimating means estimates toner concentrations in the developer after toner replenishment to the developer in each corresponding transport length, then adds differences that are obtained by comparing the estimated post-replenishment toner concentration values estimated for the developer in each transport length and the measured toner concentration values of the developer in each corresponding transport length as measured by the toner concentration measuring means after toner has been replenished by the toner replenishment control means, and based on an added value that has been obtained by the addition by the toner concentration estimating means, the toner replenishment control means adjusts the toner setting concentration value.

4. The image forming apparatus according to claim 2, wherein the toner concentration detection sensor is arranged on a downstream side in the developer transport direction from a position at which toner is replenished to the developer, based on a replenishment amount of toner to the developer to be replenished in each transport length by the toner replenishment control means, the toner concentration estimating means estimates toner concentrations in the developer after toner replenishment to the developer in each corresponding transport length, then adds differences that are obtained by comparing the estimated post-replenishment toner concentration values estimated for the developer in each transport length and the measured toner concentration values of the developer in each corresponding transport length as measured by the toner concentration measuring means after toner has been replenished by the toner replenishment control means, and based on an added value that has been obtained by the addition by the toner concentration estimating means, the toner replenishment control means adjusts the toner setting concentration value.

5. The image forming apparatus according to claim 1, wherein the toner concentration estimating means carries out an averaging process on the estimated post-development toner concentration values of the developer that have been estimated in each transport length.

6. The image forming apparatus according to claim 2, wherein the toner concentration estimating means carries out an averaging process on the estimated post-development toner concentration values of the developer that have been estimated in each transport length.

7. The image forming apparatus according to claim 3, wherein the toner concentration estimating means carries out an averaging process on the estimated post-development toner concentration values of the developer that have been estimated in each transport length.

8. The image forming apparatus according to claim 4, wherein the toner concentration estimating means carries out an averaging process on the estimated post-development toner concentration values of the developer that have been estimated in each transport length.

9. The image forming apparatus according to claim 3, wherein the toner concentration estimating means carries out an averaging process on the estimated post-replenishment toner concentration values of the developer that have been estimated in each transport length.

10. The image forming apparatus according to claim 4, wherein the toner concentration estimating means carries out an averaging process on the estimated post-replenishment toner concentration values of the developer that have been estimated in each transport length.

11. The image forming apparatus according to claim 5, wherein the averaging process is carried out by obtaining an average value of one proximal or a plurality of consecutive estimated toner concentration values including an estimated toner concentration value targeted for processing.

12. The image forming apparatus according to claim 5, wherein the averaging process is carried out according to a convolution operation that uses a distribution function.

13. The image forming apparatus according to claim 1, wherein the toner consumption amount predicting means performs divisions in the developer transport direction and a direction that intersects perpendicularly to the developer transport direction respectively on regions of images corresponding to the electrostatic latent image on the image bearing member, which are formed based on the image data stored in the storage portion, thereby obtaining rectangular image blocks, and based on image data corresponding to the image blocks that have been obtained, predicts toner consumption amounts of developer to be consumed in the image blocks, and determines predicted toner consumption amounts of developer in each corresponding transport length based on predicted toner consumption amounts of the image blocks corresponding to the image data of the specified regions for the developer in each transport length.

14. The image forming apparatus according to claim 13, wherein in obtaining the predicted toner consumption amounts of developer in each transport length, the toner consumption amount predicting means uses a total predicted toner consumption amount of image blocks corresponding to the specified region image data for developer in each corresponding transport length as the predicted toner consumption amounts of developer in each transport length, thereby obtaining the predicted toner consumption amounts of the developer in each corresponding transport length.

15. The image forming apparatus according to claim 13, wherein a coefficient corresponding to an overlap extent, by which a development trajectory virtual line, along which the developer in each transport length moves on the image bearing member during development, and the image blocks overlap, is set in advance for each of the image blocks, wherein in obtaining the predicted toner consumption amounts of developer in each transport length, the toner consumption amount predicting means multiplies the predicted toner consumption amounts of the image blocks that overlap the development trajectory virtual line of the developer in each transport length by the coefficient that corresponds to the overlap extent with the image blocks, then obtains a total thereof, thereby obtaining predicted toner consumption amounts of developer in the corresponding transport lengths.

16. The image forming apparatus according to claim 13, wherein the toner consumption amount predicting means sets a time of one circuit of the developer that circulates in the circulation transport portion of the development apparatus as an integral multiple of a time required for a single cycle of image forming.

17. A toner replenishment control method for an image forming apparatus comprising a storage portion, an image bearing member on which an electrostatic latent image is to be formed based on image data stored in the storage portion, and a development apparatus that develops the electrostatic latent image formed on the image bearing member as a toner image using a two-component developer including toner and a carrier, wherein the development apparatus is provided with:

a developer bearing member that bears the developer, a circulation transport portion that circulates the developer in a loop shape such that the developer is transported in a transport direction along an axial direction of the developer bearing member while being supplied to a circumferential surface of the developer bearing member, and a toner concentration detection sensor that detects a concentration of toner in the developer that circulates in the circulation transport portion, and is configured to carry out replenishment of toner to the developer in the circulation transport portion, wherein the toner replenishment control method comprises:

measuring the concentration of toner in the developer, which is detected by the toner concentration detection sensor, for each predetermined transport length along the developer transport direction; storing in the storage portion a measured toner concentration value of the developer in each transport length that has been measured; specifying, among image data stored in the storage portion, regions of the image data corresponding to the electrostatic latent image on the image bearing member to be developed by the developer in each transport length, and predicting toner consumption amounts of the developer in each corresponding transport length based on image data of the specified regions for the developer in each transport length that has been specified; estimating, based on the measured toner concentration values of the developer in each transport length stored in the storage portion and the predicted toner consumption amounts of the developer in each corresponding transport length, toner concentrations in the developer after development using the developer in each corresponding transport length; and carrying out, based on the estimated post-development toner concentration values of the developer in each transport length and a toner setting concentration value that has been set in advance, control of toner replenishment to the developer in each corresponding transport length.

* * * * *